US006314714B1

(12) United States Patent
Feuerlohn et al.

(10) Patent No.: US 6,314,714 B1
(45) Date of Patent: Nov. 13, 2001

(54) DEVICE FOR PRODUCING SPUN YARN

(75) Inventors: Helmut Feuerlohn, Mönchengladbach (DE); Liberto Coll-Tortosa, Barcelona; Francesc Roig Munill, Sabadell, both of (ES); Thomas Weide, Mönchengladbach (DE); Jose Antonio Tornero-Garcia, St. Salvador (ES); Oliver Schulze, Schwalmtal (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/596,373

(22) Filed: Jun. 19, 2000

(30) Foreign Application Priority Data

Jun. 18, 1999 (DE) ..... 199 27 838

(51) Int. Cl.[7] ..... D01H 7/92
(52) U.S. Cl. ..... 57/343; 57/333
(58) Field of Search ..... 57/332, 328, 341, 57/342, 343, 344, 350, 333, 315, 357, 5

(56) References Cited

U.S. PATENT DOCUMENTS 5,211,001 5/1993 Mori .
5,390,485 * 2/1995 Mori ..... 57/328
5,511,373 * 4/1996 Banba ..... 57/328
5,528,895 * 6/1996 Deno ..... 57/328
5,673,547 * 10/1997 Baba et al. ..... 57/261
5,927,062 * 7/1999 Deno et al. ..... 57/328

FOREIGN PATENT DOCUMENTS 41 31 059 C2 3/1992 (DE) .

* cited by examiner

*Primary Examiner*—Danny Worrell
(74) *Attorney, Agent, or Firm*—Kennedy Covington Lobdell & Hickman, LLP

(57) ABSTRACT

A device for producing spun yarn by means of an airflow acting in a twisting manner on the fibers of an untwisted sliver (1) as the sliver is being conducted into and through a spindle assembly (3). The spindle assembly (3) comprises a spindle head portion (5) which conically tapers toward a spindle inlet opening (2) and is rotatable independently of a spindle core portion (7) through which the yarn is withdrawn. The device suppresses any tendency of the yarn strength to decrease at high, increasing numbers of spindle revolutions.

6 Claims, 2 Drawing Sheets

DEVICE FOR PRODUCING SPUN YARN

CROSS-REFERENCES TO RELATED APPLICATIONS

This application claims the benefit of German patent application DE19927838.5, filed Jun. 18, 1999, herein incorporated by reference.

FIELD OF THE INVENTION

The present invention relates to a device for producing spun yarn, and more particularly to such a device having a housing, a guide for a drafted but untwisted sliver, a hollow spindle having a spindle head portion tapering toward a spindle entry opening for guiding therethrough a yarn formed from the sliver, and means for generating an airflow to turn or twist the fibers of the sliver.

BACKGROUND OF THE INVENTION

German Patent Application DE 199 26 492, not heretofore published, describes a device for producing spun yarn by means of an airflow, wherein a fiber guide is arranged in a block of nozzles. An untwisted sliver emerging from a drafting unit is drawn into the block of nozzles toward an arrangement of a spindle and a sliver guide. In the vicinity of an inlet opening of the spindle, the drafted but untwisted sliver is exposed to an airflow acting in a circumferential direction in the area between the sliver guide and the spindle, thereby is acted upon by a rotating movement. Here, the fibers of the sliver are subjected to the effects of the rotating airflow without controls. Subsequently, this fiber structure is drawn through the spindle for creating a yarn, during which free fiber ends are wrapped around a conically tapered head portion of the spindle and are placed around the fiber structure as covering fibers.

Yarn formation can take place with the spindle at rest, as well as when it is rotating. In the course of wrapping the free fiber ends around the conically tapered spindle head when the spindle is not rotating, a friction force is imposed between the fiber ends and the surface of the spindle head, which restrains their intended rotating movement and therefore can have negative effects, in particular at high yarn speeds. The free yarn ends cannot wrap themselves around the conical spindle head to a sufficient degree and subsequently are insufficiently placed around the draw-off yarn. As a result, the yarn speed during spinning must be limited to avoid deleterious effects on the yarn produced. Although a reduction of the disadvantages caused by such friction can be achieved by utilizing a rotating spindle, a reduction in the yarn strength rather than a desired increase in yarn strength can occur at increasing numbers of revolutions of the spindle in ranges above a certain number of revolutions, for example between 20000 rpm to 30000 rpm. With a completely rotating spindle, a rotating effect can be imposed on the yarn as a result of partial and occasional frictional contact of the interior surface of the spindle with the yarn being drawn off through the spindle inlet opening, which can cause an undesired false twisting of the yarn.

SUMMARY OF THE INVENTION

It is accordingly an object of the present invention to provide an improved spun yarn producing device of the foregoing type which addresses the above-described disadvantages of the prior art and, more particularly, which effectively counteracts a reduction of the yarn strength at high, increasing numbers of revolution of the spindle.

This objective is addressed by the present invention by providing a spindle assembly with a conical spindle head portion rotatable independently of a spindle core portion which guides the formed yarn. It is thus possible to reduce or even completely avoid negative effects on the yarn strength even at high, increasing numbers of revolution of the spindle and it is possible in this manner to prevent undesired false twisting. Such devices embodying a spindle head portion, preferably of a conical configuration, to perform a rotating movement while a stationary spindle core portion guides the drawn-off yarn are distinguished by a relatively simple structure.

A particularly advantageous effect in respect to yarn strength may be achieved if the rotary movement of the conical spindle head portion takes place in the direction of the circulating airflow, and if the surface velocity of the spindle head portion is greater than the speed of movement of the airflow circulating around the spindle head portion. A permanent wrap-around action of the free fiber ends is thereby aided and a pronounced reduction occurs of the disadvantages which can arise because of frictional losses in the course of the wrapping of free fiber ends around the spindle head portion. This has advantageous results when the number of spindle revolutions and the yarn speed are increased. It is also thereby possible to improve the yarn strength and the uniformity of the yarn.

If the spindle inlet opening is formed by a flanged annular end portion of the spindle core portion or any other ring form which is fixedly connected with the spindle core portion, and if the conical spindle head portion is at least partially covered by the flange or ring, an undesired rotational effect exerted by the rotating spindle head portion on the yarn is completely prevented.

In an embodiment of the device, wherein the spindle core portion is mounted in the housing and the spindle head portion is rotatably seated by means of a bearing arranged between the spindle head and spindle core portions, a compact structure and a low-friction seating is possible. These advantages can be increased if the bearing of the spindle head portion is provided, for example, by needle bearings. In an alternative simple, stable and space-saving embodiment, the spindle head portion is rotatably seated in an easily accessible bearing supported on the outer circumference of the spindle head portion, and the spindle core portion, as well as the bearing, are mounted in the housing.

Thus, with the present invention, the rotating portion of the spindle assembly can be limited to a large degree to the area of the spindle head portion. With such an embodiment, the mass which must be moved can be kept relatively small. Small masses to be moved can also be achieved by means of a spindle head portion of lightweight construction, for example in the form of a thin-walled cone.

The device in accordance with the present invention reduces or prevents negative effects on yarn strength by frictional losses, even at high, increasing numbers of spindle revolutions. By means of improved wrap-around of the fibers, it is possible to perform the spinning process at high yarn speeds, without it being necessary to accept disadvantages because of a reduction of yarn strength. The production process of the yarn is improved.

Further details, features and advantages of the present invention will be explained and understood from the following disclosure of exemplary embodiments represented in the accompanying drawings.

DETAILED DESCRIPTION OF THE PREFERRED EMBODIMENTS

Figure 1:
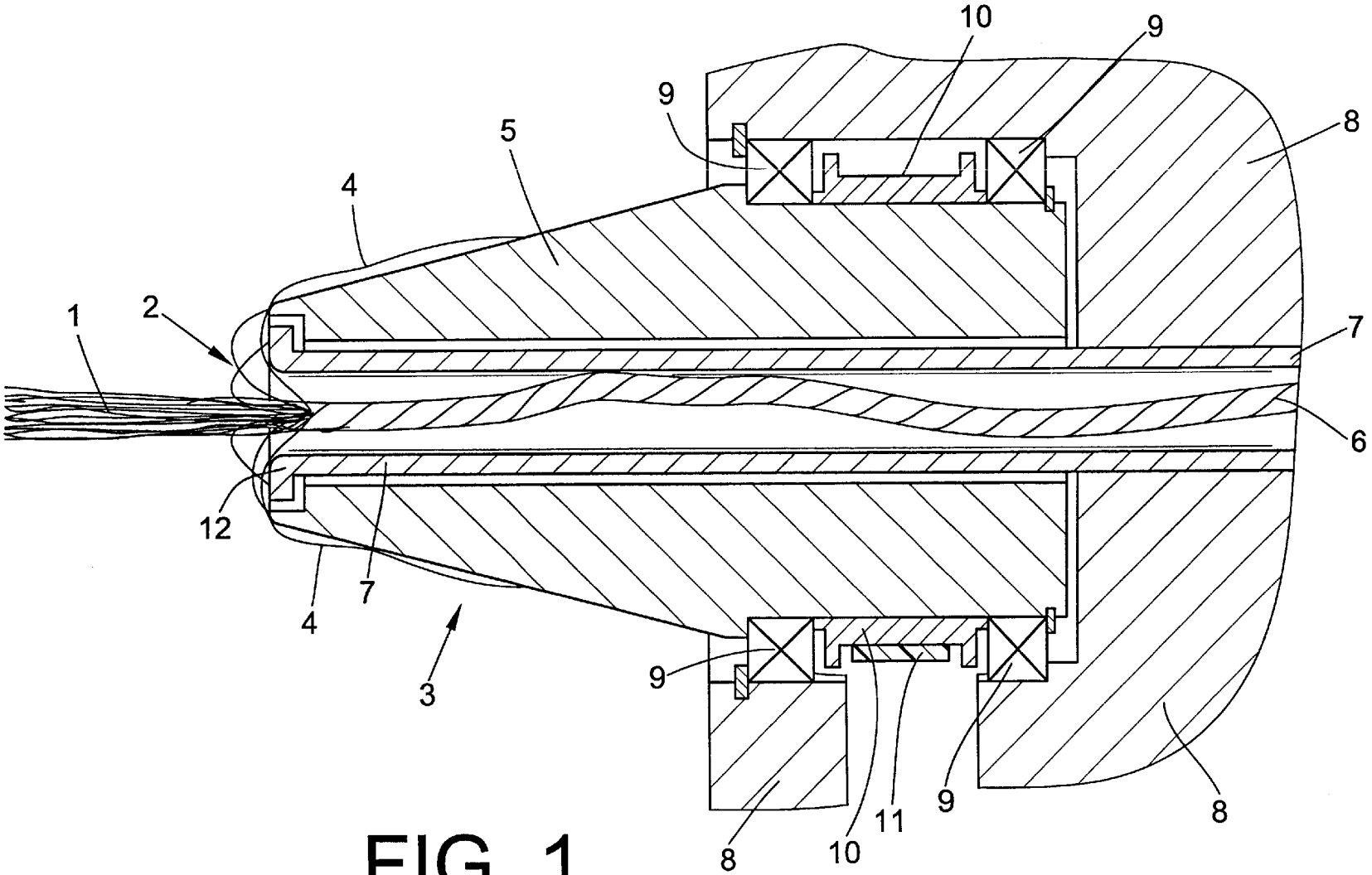
FIG. 1 is a schematic partial representation of a spinning device in accordance with one embodiment of the present invention, shown in axial cross-section.

Referring now to the accompanying drawings and initially to FIG. 1, a first embodiment of a spinning device according to the present invention is shown wherein a previously drafted but untwisted sliver 1 is delivered to an inlet opening 2 of a spindle assembly 3 while being rotated by means of an airflow, not represented. In the process, the rotating airflow detaches free fiber ends 4 from the sliver 1 and these free fiber ends 4 are then wrapped around a spindle head portion 5 of the spindle assembly 3. More specifically, the yarn 6 is withdrawn by means of a spindle core portion 7 embodied in the form of a tube, during which the fiber ends 4 wrapped around the spindle head portion 5 are drawn into the core portion 7, are wrapped around the sliver 1 in the process, and form covering fibers of the yarn 6.

In the course of this process of producing yarn with the spindle assembly, particularly the spindle head portion 5, stationary, the fiber ends 4 wrapping around the spindle head portion 5 create friction by sliding on the surface of the spindle head portion 5. This impediment to the yarn forming process caused by such friction can be reduced by rotating the spindle head portion 5, as aforementioned. Thus, as shown, spindle head portion 5 is rotatably seated in the housing 8 and conically tapers in the direction toward the spindle inlet opening 2 so as to form an annulus of the spindle assembly 3 surrounding and defining the spindle inlet opening 2. The rotatable seating of the spindle head portion 5 is provided by rotational bearings 9, which are preferably embodied as roller bearings. A drive belt 11 is guided in a ring 10 about the spindle head portion 5 and imparts a driven rotating movement to the spindle head portion 5. Drive mechanisms of this type are known and are therefore not shown in detail here for reasons of simplicity. The ring 10 is simultaneously used as a spacer between the rolling bearings 9 for fixing them in place. The spindle core portion 7 is seated in a manner so that it is releasable from the housing 8 and therefore it is held in a stationary non-rotating disposition in this embodiment. The end of the spindle core portion 7 at the spindle inlet opening 2 is embodied as an annular outwardly extending flange 12 whereby the flange 12 covers the forward end of the spindle head portion 5. As a result, the sliver 1 and the yarn 6 cannot come into contact with the rotating spindle head portion 5 and an undesired false twist is prevented, thereby simultaneously counteracting any reduction or negative effect on yarn strength, even at high, increasing numbers of spindle revolution.

Figure 2:
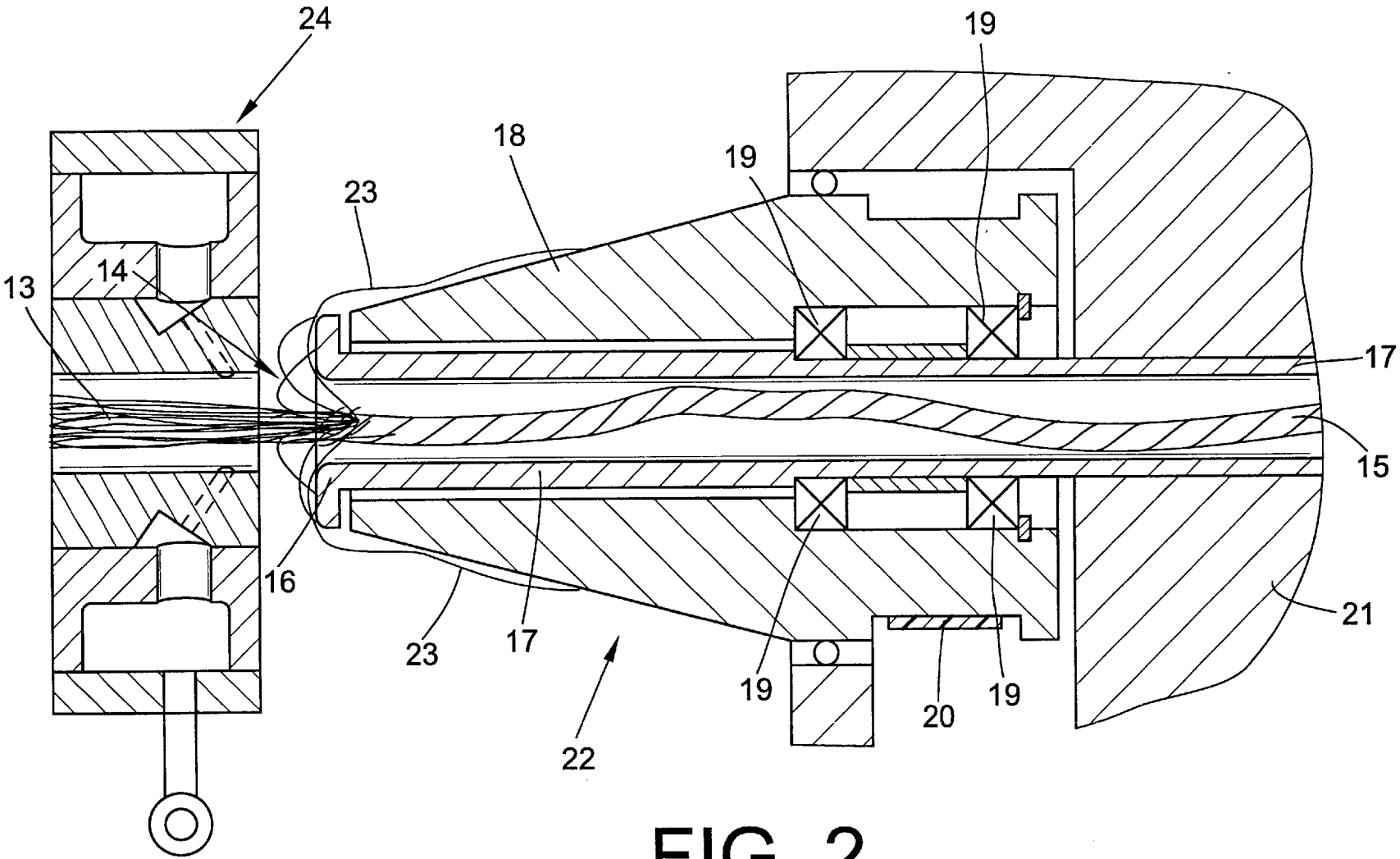
FIG. 2 is another schematic representation of a spinning device, similar to FIG. 1, showing a second embodiment of the present invention also in axial cross-section.

FIG. 2 represents an alternative embodiment of spindle assembly according to the present invention for producing spun yarn. A drafted sliver 13 is supplied to the spindle inlet opening 14 and is drawn off as the yarn 15. As in the first embodiment, the sliver 13 and the drawn-off yarn 15 produced therefrom are protected against direct contact with the rotating spindle head 18 by an end portion of the spindle core portion 17 embodied in the form of an annular flange 16 at the spindle inlet opening 14. In this embodiment, the spindle head portion 18 is seated on the stationary spindle core portion 17 by means of rotational bearings 19, preferably in the form of ball bearings, disposed between the annular exterior surface of the spindle core portion 17 and the annular interior surface of the spindle head portion 18. Rotational movement is imparted to the spindle head portion 18 by a drive belt 20. The stationary spindle core portion 17 is mounted in the housing 21.

With the embodiments of the spindle assemblies 3, 22 as shown, frictional forces imposed on the free fiber ends 4, 23 are reduced by the rotation of the spindle head portion 5, 18, on the one hand, and any resultant decrease of the yarn strength is also reduced, or altogether prevented. Undesired false twisting of the yarn 6, 15 caused by the rotation of the spindle head portion 5, 18 is not possible.

In an alternative embodiment, the rotational bearing 9, 19 can be embodied as needle bearings. Seating of this type causes little friction and permits a construction with a compact spindle head portion 5, 18, as well as a construction with small rotating masses. The spindle head portion can be designed to be of thin-walled lightweight construction. As a result, the masses to be moved can be kept low.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A device for producing spun yarn, comprising:

(a) a housing, (b) a spindle assembly having a sliver entry opening for receiving a drafted, untwisted sliver to be formed into a yarn, a stationary hollow guide portion for guiding therethrough a yarn formed from the sliver, a conical spindle head portion which tapers in the direction of the sliver entry opening, and means for rotation of the spindle head portion independently relative to the stationary guide portion, and (c) means for generating an airflow rotationally about the spindle head portion for imparting a rotational turning to fibers of the drafted, untwisted sliver.

2. The device in accordance with claim 1, wherein the guide portion of the spindle assembly comprises a core portion supported stationarily within the spindle head portion, and characterized further by a drive for positively rotating the spindle head portion.

3. The device in accordance with claim 2, characterized in that the drive rotates the spindle head portion in the direction of the airflow at a surface velocity of the spindle head portion greater than the speed of the airflow thereabout.

4. The device in accordance with claim 2, characterized in that the spindle core portion includes an annular flange at one end thereof defining the sliver inlet opening and at least partially covering the spindle head portion.

5. The device in accordance with claim 2, characterized in that the spindle core portion is mounted stationarily in the housing and the means for rotation of the spindle head portion comprises a bearing arranged between the spindle head portion and the spindle core portion.

6. The device in accordance with claim 2, characterized in that the spindle core portion is mounted stationarily in the housing and the means for rotation of the spindle head portion comprises a bearing mounted in the housing to support the spindle head portion exteriorly thereof.

* * * * *